United States Patent [19]

McElhaney

[11] 4,227,393

[45] Oct. 14, 1980

[54] METHOD AND APPARATUS FOR PUNCHING OPENINGS IN TUBES

[75] Inventor: William G. McElhaney, Jacksonville, Tex.

[73] Assignee: Anvil Corporation, Jacksonville, Tex.

[21] Appl. No.: 688

[22] Filed: Jan. 3, 1979

[51] Int. Cl.[3] ..... B21D 31/02

[52] U.S. Cl. ..... 72/327; 83/191

[58] Field of Search ..... 83/191; 72/327, 326, 72/333, 334, 329

[56] References Cited

U.S. PATENT DOCUMENTS

| | | | |
|---|---|---|---|
| 2,749,983 | 6/1956 | Rogers | 83/191 |
| 2,884,066 | 4/1959 | Teplitz et al. | 166/58 |
| 3,064,707 | 11/1962 | Walts | 72/327 X |
| 3,087,362 | 4/1963 | Genier | 72/327 |
| 3,259,003 | 7/1966 | Griffin | 72/325 X |
| 3,271,988 | 9/1966 | Klinksiek | 83/191 X |
| 3,811,352 | 5/1974 | McFadden | 83/54 |
| 3,815,399 | 6/1974 | Foulks et al. | 72/325 X |
| 3,995,518 | 12/1976 | Spiroff | 83/191 X |

*Primary Examiner*—Milton S. Mehr

*Attorney, Agent, or Firm*—Richards, Harris & Medlock

[57] ABSTRACT

An apparatus for punching openings in tubing (T) includes a stationary mandrel (50) having a guide aperture (142) through the walls thereof and adapted for insertion within the tubing to be punched. A moving actuator (110) having an inclined ramp (130) on one end is receivable within the stationary mandrel. A punch (134) is provided having an inclined end for engagement on the inclined ramp of the moving actuator and an opposite end for engagement through guide aperture (142) in the wall of the stationary mandrel. A T-shaped slot (136) is provided on the inclined end of the punch and a corresponding T-shaped ramp (132) is provided on the inclined ramp of the moving actuator. The engagement of ramp (132) in slot (136) provides for sliding engagement of the punch on the actuator. T-shaped slot (136) and ramp (132) are symmetrical about a plane through the longitudinal axis of the punch and the moving actuator. A stop bar (56) extends to one side of stationary mandrel (50). A plurality of stop arms (66) are hingedly secured to the stop bar for selective engagement against stationary mandrel (50) to act as dimensioning guides. A clamp structutre (60) is supported from stop bar (56) and is selectively movable from a first position circumferentially engaging the tubing mounted on the stationary mandrel and a second position wherein the clamp structure is removed from circumferential engagement of the tubing. Clamp structure (60) has an indentation (154) therein corresponding to the position of punch (134) such that the side wall of the tubing surrounding the area to be punched is supported during the punching operation.

13 Claims, 10 Drawing Figures

METHOD AND APPARATUS FOR PUNCHING OPENINGS IN TUBES

TECHNICAL FIELD

The present invention relates to an apparatus and method for punching holes in tubing walls and more particularly to a method and apparatus for punching round holes through the side walls of tubing from the interior of the tubing.

BACKGROUND ART

In the production of many work pieces, it is necessary to employ tubing having one or more holes formed or cut in the side wall. In the past, it has been the practice to cut holes in the side wall of the tubing from the exterior. This has been accomplished by drilling the holes or by forcing a punch inwardly against the side wall of the tubing. In both of these practices, a flange or burr is formed in the interior of the tube requiring additional steps to clean the opening of these formations. Additionally, when the aperture is formed from the exterior of the tube, punching or cutting the hole often results in deformation of the tube.

Openings in the side wall of tubes have also been formed from the interior of the tube. Two methods of forming such openings in tubes re shown in the patent to K. W. Klinksiek, U.S. Pat. No. 3,271,988, issued Sept. 13, 1966 and the patent to J. R. Griffin, U.S. Pat. No. 3,259,003, issued July 5, 1966. The Klinksiek patent discloses a method for using a ram with an inclined ramp for forcing a punch against the side wall of a hollow work piece. Although the aperture is formed from the interior of the work piece, the connecting structure between the ram and punch are nonsymmetrical about a plane through the center line of the punch and ram. Thus, the punch is loaded off-center causing irregular punch action.

The Griffin reference employs a much different approach wherein a plurality of punches are mounted on a shaft which is raised by the action of an inclined second shaft moving relative to the punch shaft.

It has also become important to provide proper dimensioning apparatus such that a plurality of holes may be formed sequentially in a tube without requiring the work piece to be remeasured for each opening formed. At the same time, a means for providing outside wall support around the area to be punched by the apparatus has been needed.

DISCLOSURE OF INVENTION

The present invention provides a method and apparatus for forming openings in tubes eliminating the problems heretofore experienced in the prior art and providing for the repeated processing of tubing by sequentially forming a plurality of apertures therein. In the preferred embodiment of the invention, the apparatus includes a tubular stationary mandrel extending outwardly from a housing and having guide apertures through the wall thereof. The stationary mandrel is sized to receive tubing thereon. A moving actuator having an inclined ramp on one end is positioned within the stationary mandrel. A punch is provided having an inclined end for engagement on the inclined ramp of the moving actuator and an opposite end for engagement through the guide aperture in the wall of the stationary mandrel. Structure is provided on the inclined end of the punch and the inclined ramp of the moving actuator to provide for sliding engagement of the punch on the actuator. The structure is symmetrical about a plane through the longitudinal axis of the punch and the moving actuator.

A power unit is provided for moving the actuator relative to the stationary mandrel whereby the punch is caused to move on the inclined ramp of the actuator and forced radially outwardly through the guide aperture of the mandrel to punch an opening through the side wall of the tubing. By retracting the power actuator, the punch is withdrawn into the mandrel and out of the tubing as it translates down the inclined ramp of the actuator to permit movement of the tubing off of the stationary mandrel.

In accordance with a more specific embodiment of the invention, the interlocking structure between the punch and the inclined ramp of the moving actuator includes a T-shaped groove in the bottom surface of said punch and a corresponding T-shaped ramp formed on the ramp of the moving actuator for interlocking engagement with the groove of the punch.

In accordance with another embodiment of the invention, a pair of stop bars extend from the housing and parallel to the stationary mandrel. A plurality of stop arms are hingedly secured to the stop bar for selective engagement against the stationary mandrel. The stop arms may be selectively moved and secured along the longitudinal axis of the stop bar to permit varying the position of engagement of the stop arms on the stationary mandrel.

In use of the punch apparatus, the stop arms are engaged against the stationary mandrel to act as a dimensioning guide for the operator. Specifically, tubing is inserted over the stationary mandrel until the tubing engages one of the stop arms resting on the stationary mandrel. After a punch operation, the stop arm is pivoted away from the stationary mandrel and the tubing advanced on the mandrel until the tubing engages a second stop arm. Again, the punching operation is executed, the stop arm is pivoted away from the mandrel and the tube advanced to engagement with a third stop arm. By positioning the stop, arms at selected positions along the stationary mandrel, apertures in the tubing may be punched in desired positions relative to the end of the tubing.

In accordance with one embodiment of the invention, the stationary mandrel is attached to the housing such that it may be rotated about its longitudinal axis to selectively orientate the guide apertures as desired. Because the stationary mandrel and the guide apertures therein are movable relative to the housing, the punch may be made to operate in any desired radial direction.

In accordance with another embodiment of the invention, a clamp structure is supported from the stop bar and is selectively movable from a first position circumferentially engaging the tubing mounted on the stationary mandrel and a second position wherein the clamp structure is removed from circumferential engagement of the tubing. In one embodiment of the invention, the clamp structure has an indentation therein corresponding to the position of the punch such that the punch protrudes through the tubing at the indentation. In this embodiment, the clamp structure provides support immediately adjacent to the punch as it is forced through the side wall of the tubing. This support prevents the outward extrusion of the side wall around the periphery of the punched hole. A "flat" or contour fitting hole is the result.

In accordance with a more specific embodiment of the invention, the clamp structure includes a pair of movable jaws supported for movement on a plate mounted to the stop bars. Cam structure is provided for selectively moving the jaws between the first position circumferentially engaging the tubing and the second position wherein the jaws are removed from engagement with the tubing.

In accordance with a more specific embodiment of the invention, the clamp structure is supported from a pair of stop bars extending parallel to and on opposite sides of the stationary mandrel.

DESCRIPTION OF THE DRAWINGS

For a more complete understanding of the present invention, and for further details and advantages thereof, reference is now made to the following description taken in conjunction with the accompanying drawings, in which.

DESCRIPTION OF THE PREFERRED EMBODIMENT

Figure 1:
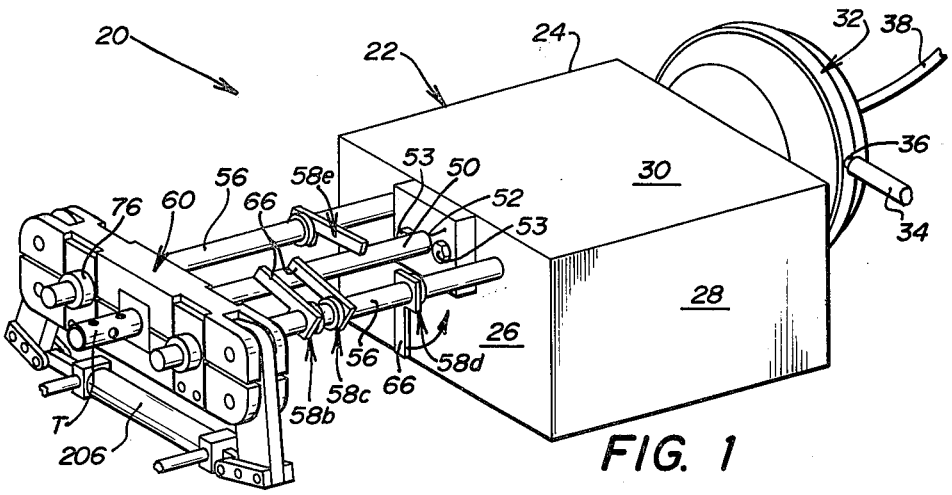
FIG. 1 is a perspective view of the punch apparatus of the present invention.

Referring to FIG. 1, there is illustrated the punch apparatus 20 of the present invention including an enclosed actuator unit 22. Actuator unit 22 includes a housing 24 having a front plate 26, side plates 28 and top plate 30. A pneumatic drive unit 32 is mounted on housing 24 opposite front plate 26. A pneumatic hose 34 is coupled by way of fitting 36 to unit 32 to supply air to the drive unit. An exhaust line 38 is also coupled to unit 32 for exhausting the air used to drive the unit.

A stationary mandrel tube 50 is mounted to front plate 26 by mandrel mounting plate 52. Mounting plate 52 is removably attached to front plate 26 by bolts 53. As will be hereinafter discussed in greater detail, this attachment permits the rotation of mandrel 50 about its longitudinal axis as desired. As is shown in FIG. 1, a section of tubing T is receivable over stationary mandrel 50.

A pair of swing stop bars 56 are attached to and extend outwardly from front plate 26. Bars 56 are mounted parallel to stationary mandrel 50 and on opposite sides thereof. A plurality of swing stops 58*a*, 58*b*, 58*c*, 58*d* and 58*e* are slidably mounted from swing stop bars 56 as will be discussed hereinafter in greater detail.

Figure 9:
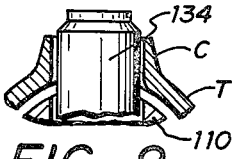
FIG. 9 illustrates a partial section view taken at the same location as the section of FIG. 5 but without the clamp structure in place.
Figure 10:
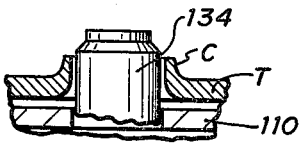
FIG. 10 illustrates a partial section view taken at the same location as the section of FIG. 6 but without the clamp structure in place.

A clamp structure 60 is likewise mounted from swing stop bars 56 and is engaged around stationary mandrel 50. As will be hereinafter discussed in greater detail, clamp structure 60 supports tubing T during the punching process to assure that the portion of the tube around the hole is not deformed or extruded outwardly to form a flange. The clamp structure therefore permits the punching of what is called a "flat hole", that is, a hole through the side wall wherein the side wall of the tube immediately surrounding the hole is not deformed outwardly to any significant extent. While clamp structure 60 is shown in FIGS. 1–8, it will be understood that the clamp structure is used only when a flat hole is desired. However, the invention is intended to cover the formation of holes having a flange or collar around the periphery thereof as when the hole is formed without the use of the clamp structure. This embodiment is illustrated in FIGS. 9 and 10 and will be discussed hereinafter. Therefore, the present invention is intended to cover a system for forming holes both with and without the clamp structure 60.

Figure 2:
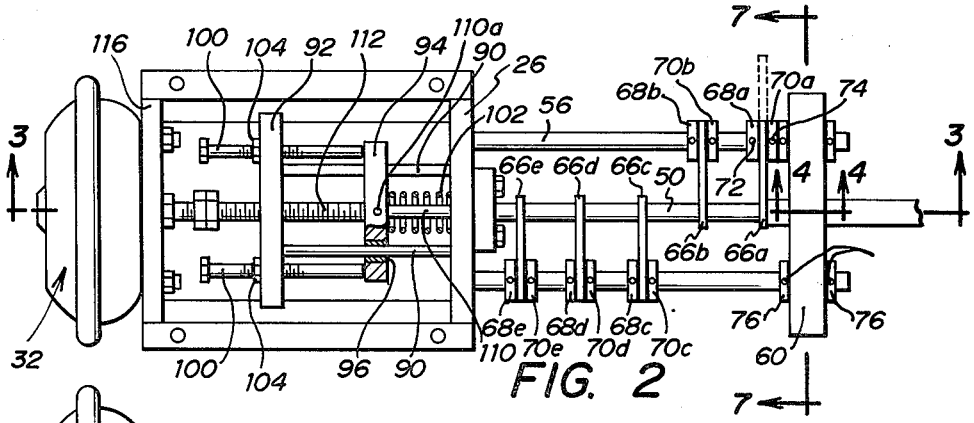
FIG. 2 is a top view of the apparatus illustrated in FIG. 1 with the top plate of the actuator unit housing removed.

While FIGS. 1 and 2 illustrate clamp structure 60 as mounted on stop bars 56, it will also be understood that this structure may be positioned relative to stationary mandrel tube 50 by being supported by structure other than stop bars 56 without departing from the spirit and scope of the present invention.

Figure 3:
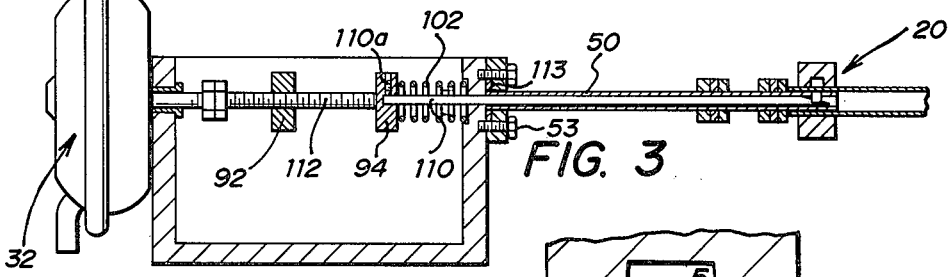
FIG. 3 is a vertical section view taken along lines 3—3 of FIG. 2.

Referring now to FIGS. 2 and 3, swing stops 58*a*, 58*b*, 58*c*, 58*d* and 58*e* include swing stop arms 66*a*, 66*b* 66*c*, 66*d* and 66*e*, respectively, mounted on swing stop bar 56 and associated locking collars 68 and 70. Each stop bar is held in position by locking collars 68*a*–68*c* and 70*a*–70*c* positioned on opposite sides of arm 66. Collars 68 and 70 are selectively engageable to bars 56 by set screws 72 and 74, respectively. By moving collars 68 and 70 along the longitudinal length of swing stop bars 56, swing stop arms 66 may be positioned at any desired longitudinal point on bars 56. As is illustrated in FIG. 2, arms 66 pivot about swing stop bar 56 and are of sufficient length to engage stationary mandrel 50 when pivoted thereagainst. While FIGS. 1, 2 and 3 illustrate the use of five swing stops 58*a*–58*e*, it will be understood that any number of swing stops may be positioned on bars 56 as desired.

Clamp structure 60 is similarly positioned on swing stop bars 56 by locking collars 76 positioned on opposite sides of clamp structure 60 and selectively attached to swing stop bar 56 by set screws 78.

Referring still to FIGS. 2 and 3, the actuator unit 22 is shown in more detail. A pair of guide rods 90 extend parallel from the interior front plate 26 of housing 24. A stop plate 92 is attached to the ends of guide rods 90 opposite their attachment to front plate 26. A slide mounting plate 94 is mounted for sliding movement on guide rods 90. Guide bushings 96 (FIG. 2) mounted between slide mounting plate 94 and rods 90 facilitate the sliding movement therebetween. A pair of rear travel adjustment rods 100 are threadedly received through stop plate 92 and engage slide mounting plate 94. A spring 102 is fitted between mounting plate 94 and front plate 26 to bias mounting plate 94 towards stop plate 92. The travel of mounting plate 94 is arrested by engagement against rear travel adjustment rods 100. Adjustment rods 100 are fitted with lock nuts 104.

A moving actuator 110 is mounted within stationary mandrel 50 and has one end secured by set screw 110*a* within slide mounting plate 94 for movement therewith. A drive rod 112 extends through rear plate 116 and stop plate 92 and has one end in engagement with slide mounting plate 94. Drive rod 112 is driven along its longitudinal axis by drive unit 32.

Referring to FIG. 3, stationary mandrel 50 is formed with a collar 113 on one end thereof. Collar 113 is clamped between mounting plate 52 and front plate 26 by the engagement of bolts 53 through mounting plate 52 into plate 26. This clamping action rigidly secures mandrel 50 to actuator unit 22.

Figure 4:
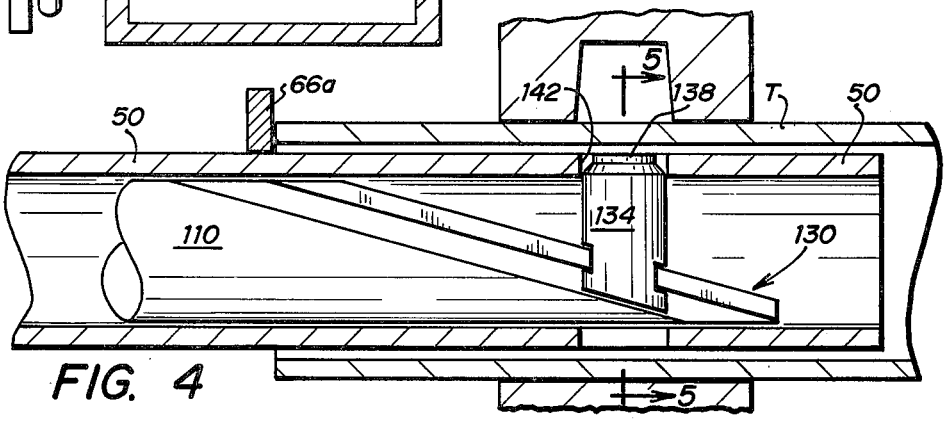
FIG. 4 is an enlarged section view taken along lines 4—4 of FIG. 2, with the punch in the retracted position.
Figure 5:
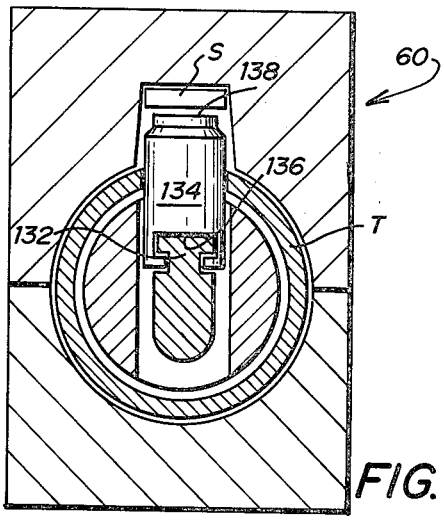
FIG. 5 is a section view taken along lines 5—5 of FIG. 4.
Figure 6:
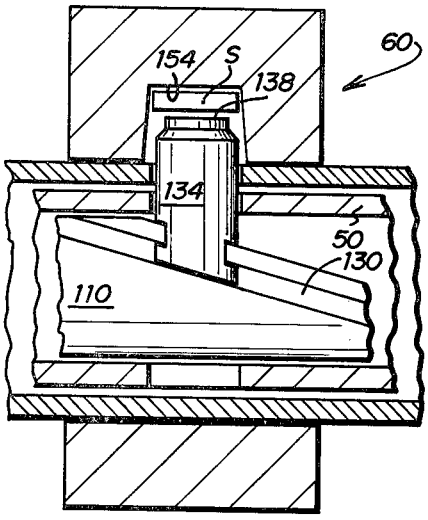
FIG. 6 is an enlarged section view similar to FIG. 4 but with the punch in its extended position.

As is shown in FIGS. 4, 5 and 6, moving actuator 110 has an inclined end 130. Referring to FIG. 5, the upper surface of the inclined end is formed in the shape of a T-section 132. A punch 134 is formed with a corresponding T-shaped slot 136 in the base thereof corresponding to T-shaped section 132 of moving actuator 110 and a cutting surface 138 opposite slot 136.

Punch 134 mates with moving actuator 110 by the engagement of T-section 132 of actuator 110 within the corresponding T-shaped slot 136 of punch 134. Stationary mandrel 50 is formed with an aperture 142 therein for receiving punch 134 (FIG. 4).

Figure 7:
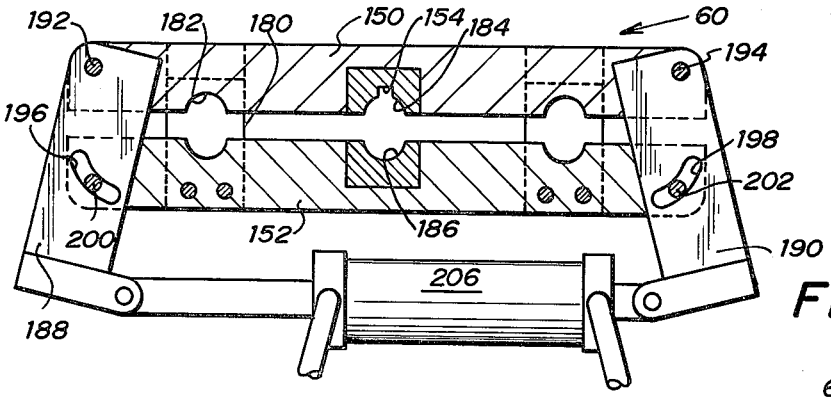
FIG. 7 is a section view taken along lines 7—7 of FIG. 2 showing the clamp structure in the open position.
Figure 8:
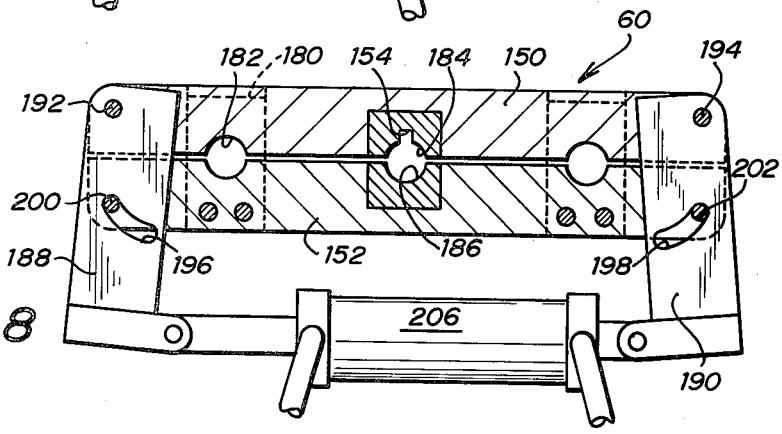
FIG. 8 illustrates the section view of FIG. 7 with the clamp structure in the closed position.

Referring to FIGS. 7 and 8, clamp structure 60 includes an upper jaw 150 and a lower jaw 152 for circumferential engagement around tube T when the tube is mounted on stationary mandrel 50. Upper jaw 150 is formed with an indentation 154 corresponding to the position of punch 134 at aperture 142 in stationary mandrel 50. Clamp structure 60 provides support for the tubing around the area to be punched as will be discussed hereinafter in greater detail.

Referring to FIG. 7, clamp structure 60 is shown in more detail in the unlocked position. Upper jaw 150 is aligned with lower jaw 152 by slide bars 180. Bars 180 maintain jaws 150 and 152 in a parallel relationship while permitting the movement of upper jaw 150 toward lower jaw 152. Plates 180 are formed with apertures 182 for receiving swing stop bars 56 therein. Upper jaw 150 is formed with a half circle trough 184 corresponding to a half circle trough 186 formed in lower jaw 152. Indentation 154 in trough 186 is shown in FIGS. 7 and 8. Actuator arms 188 and 190 are pinned at pins 192 and 194, respectively, to upper jaw 150. Arms 188 and 190 are formed with arcuate slots 196 and 198, respectively, to receive pins 200 and 202, respectively, attached to lower jaw 152. A variable length linkage 206 is attached between arms 188 and 190 at their ends opposite the point of pivotal attachment at pins 192 and 194 to upper jaw 150. By varying the length of linkage 206, upper jaw 150 is drawn into engagement against lower jaw 152, and tubing T clamped therebetween. Variable linkage 206 may be any of a number of standard units operated pneumatically to contract and extend in length as necessary to operate clamp structure 60.

When the clamp structure is used so that a "flat hole" is punched, the operation of the punch apparatus is as follows. Stop arms 66 are selectively positioned along the longitudinal length of stop bars 56 such that the stop arms engage stationary mandrel 50 at required distances from punch 134 and aperture 142 formed in stationary mandrel 50. Referring to FIG. 4, a tube T is inserted over stationary mandrel 50 until its end is butted against the first swing stop arm **66*a* (FIGS. 1 and 4**).

As will now be appreciated, with tube T positioned against stop arm **66*a*, the tube is dimensioned such that a hole will be punched a distance from the end of the tube equal to the distance from the leading edge of stop arm 66*a* and aperture 142 of stationary mandrel 50. With the tube in position, pneumatic variable linkage 206 is activated to draw in jaw 150 toward jaw 152 to circumferentially clamp tube T in troughs 184 and 186. As can be seen in FIG. 6, indentation 154 is positioned immediately above punch 134 and aperture 142 of stationary mandrel 50 when the clamp structure 60** is in its clamp position.

Compressed air is injected through hose 34 into drive unit 32 to force drive rod 112 outwardly along its longitudinal axis. In turn, moving actuator 110 is translated relative to stationary mandrel 50 along the longitudinal axis of the actuator. This movement causes punch 134 to ride up inclined end 130 of moving actuator 110 and to be extended radially through the side wall of tubing T, severing a flat slug S from tubing T. By loosening bolts 53 to free collar 113, mandrel 50 may be disconnected from plate 26. Mandrel 50 may then be selectively rotated about its longitudinal axis such that guide apertures 142 are oriented at different radial positions. At the same time, set screw **110*a* is withdrawn from engagement with actuator 110 allowing actuator 110 and punch 134 to translate with mandrel 50. By rotating mandrel 50, actuator 110 and punch 134**, punching operations may be carried out at any desired radial orientation.

It will be appreciated from viewing FIG. 6 that clamp structure 60 reinforces tubing T around the periphery of the area being punched by punch 134. However, there is no contact between jaw 150 of clamp structure 60 and punch 134. Rather, there is a small clearance between the two elements even during the punch cycle. As is shown in FIGS. 4, 5 and 6, as a result of the support provided by jaw 150 of clamp structure 60, the aperture in the tubing is formed without the formation of an outwardly extending flange or collar. Thus, a "flat hole" is produced.

Alternatively, the punch structure of the present invention may be used without clamp structure 60 to produce an opening in the side wall of tubing. Where the punch operation is accomplished without the use of clamp structure 60 in place, the punching operation is identical with the exception that the area immediately surrounding the hole is formed differently than that resulting when the clamp structure is used. Referring specifically to FIGS. 9 and 10, it is seen that the formation of the aperture in the tubing from the inside of the tube causes the formation of a collar C extending outwardly and around the entire periphery of the aperture punched in the tube. This collar has been found to be extremely beneficial for connecting an auxiliary tube to tubing T at the aperture. The joint between auxiliary tubing and the tubing having the aperture punched therein has superior strength as a result of the collar formed in the punching process. Therefore, there is less likelihood of leaking at the joint. Moreover, the joint has a better appearance than prior art connections of this type.

More significant, however, is the fact that the flow characteristics of such a joint are more laminar in comparison to the turbulent conditions that exist in the conventional manifold joint. The reduction of turbulent flow eliminates resistance to flow in the tubing and therefore the movement of fluid through the tubing is smoother. This in turn results in improved overall operation of the system using the tubing. Moreover, less solder or other bonding material is needed to make the joint because of the collar produced by the punch process.

Thus, the present invention provides a system for punching a hole providing a collar around the periphery thereof as illustrated in FIGS. 9 and 10, or alternatively producing a "flat hole" in the side wall of the tubing where no collar is produced. Naturally, the decision as to whether to use the clamping structure will be determined by the application in which the tube is to be used and the type of hole needed to fulfill the requirements of that application.

Further, the present invention is far advantageous to the use of drills or similar tools for cutting apertures in the tubing. The present invention does not produce drill chips or burrs which require additional time and effort to remove. Moreover, a round slug is punched in the present procedure which can be easily collected and sold as pure scrap.

After the aperture has been formed, drive unit 32 is deenergized and spring 102 acts against mounting plate 94 to retract moving actuator 110. Punch 134 continues to ride along inclined end 130 and is drawn radially inwardly to the position shown in FIG. 4.

Once the punching operation has been completed, variable linkage 206 of clamp structure 60 is lengthened. As a result, arms 188 and 190 are pivoted to move upper jaw 150 away from lower jaw 152 and out of circumferential engagement with tubing T.

Stop arm 66*a* is then pivoted about swing stop bar 56 to the position shown in phantom in FIG. 2, and tubing T is advanced inwardly until engagement is made with stop arm 66 *b*. Then the punch procedure is carried out again as described above and stop arm 66*b* is pivoted out of position and tubing T advanced until engagement with the next stop arm. In this way, an operator may perform a series of dimensioned punch operations without making any measurements whatsoever. Rather, the series of punch operations set up in accordance with the dimensions from the punch and each of the stop arms, and the punch sequence defined by these dimensions may be repeated in a plurality of tubing sections. After the last punch has been made, tubing T is withdrawn from stationary mandrel 50 and another section of tubing is advanced on the unit for processing.

As is shown in FIG. 6, the interconnection between moving actuator 110 and punch 134 is by way of a T-section 132 on inclined end 130 of moving actuator 110 and a corresponding T-shaped slot 136 in the lower end of punch 134. These sections are symmetrical about a plane through the longitudinal axis of punch 134 and moving actuator 110 such that the loading between the actuator and punch 134 are directed substantially in this plane. In this way, the punch moves substantially in the plane without any tendency to twist or skew through the tubing resulting in a cleaner, more precise punching operation. Moreover, the wear on the punch and moving actuator is more uniform along the surfaces of contact therebetween, thus limiting the wear and likelihood of failure in these components. This assures a longer useful life for these elements than in the prior art punch apparatus.

Although preferred embodiments of the invention have been described in the foregoing detailed description and illustrated in the accompanying drawings, it will be understood that the invention is not limited to the embodiments disclosed, but is capable of numerous rearrangements, modifications and substitutions of parts and elements without departing from the spirit of the invention. For example, other means of supplying the force for driving the moving actuator within the stationary mandrel than those disclosed may be employed to carry out the present invention. Likewise, other power means than those described may be used to engage the clamping structure about the tubing during the punch operation. The present invention also envisions the use of dyes of various shapes to produce differing apertures both in size and configuration. The present invention is therefore intended to encompass these and other rearrangements, modifications and substitutions of parts and elements as fall within the scope of the appended claims.

I claim:

1. An apparatus for punching an opening through tubing comprising:

a stationary mandrel having a guide aperture through the wall thereof and being insertable within the tubing, a moving actuator having an inclined ramp on one end thereof and receivable within the stationary mandrel, a punch having an inclined end for engagement on the inclined ramp of said actuator and an opposite end for engagement through the guide aperture in the wall of said stationary mandrel, interlocking structure on the inclined end of said punch and the inclined ramp of the moving actuator for slidable engagement of the punch on the actuator, such that said punch moves up the inclined ramp of said moving actuator as said actuator is advanced into said stationary mandrel and said punch moves down the inclined ramp of said moving actuator as it is withdrawn from said stationary mandrel, and power means for moving said moving actuator into said stationary mandrel whereby said punch is caused to move upwardly on the inclined ramp of said moving actuator and forced radially outward through the guide aperture of said stationary mandrel to punch an opening through the side wall of the tubing and for withdrawing said actuator out of said stationary mandrel to move said punch down the inclined ramp and radially inwardly within the tubing.

2. The apparatus according to claim 1 wherein said interlocking structure is symmetrical about a plane through the longitudinal axis of said punch and said moving actuator.

3. The punching apparatus of claim 1 wherein said interlocking structure comprises:

an inclined T-shaped groove in the bottom surface of said punch and a corresponding T-shaped ramp extending on the ramp of said moving actuator corresponding in shape to the T-shaped groove in said punch for interlocking engagement within the groove of said punch.

4. An apparatus for punching an opening through tubing comprising:

a stationary mandrel having a guide aperture through the wall thereof and being insertable within the tubing, a moving actuator having an inclined ramp on one end thereof and receivable within the stationary mandrel, a punch having an inclined end for engagement on the inclined ramp of said actuator and an opposite end for engagement through the guide aperture in the wall of said stationary mandrel, interlocking structure on the inclined end of said punch and the inclined ramp of the moving actuator for slidable engagement of the punch on the actuator, power means for moving said moving actuator relative to said stationary mandrel whereby said punch is caused to move on the inclined ramp of said moving actuator and forced radially outward through the guide aperture of said stationary mandrel to punch an opening through the side wall of the tubing, a stop bar extending parallel to said stationary mandrel, and a plurality of stop arms hingedly secured to said stop bar for selective engagement against said stationary mandrel, said stop arms being selectively positionable along the longitudinal axis of said stop bar to permit varying the position of engagement of said stop arms on said stationary mandrel.

5. An apparatus for punching an opening through tubing comprising:

a stationary mandrel having a guide aperture through the wall thereof and being insertable within the tubing, a moving actuator having an inclined ramp on one end thereof and receivable within the stationary mandrel, a punch having an inclined end for engagement on the inclined ramp of said actuator and an opposite end for engagement through the guide aperture in the wall of said stationary mandrel, interlocking structure on the inclined end of said punch and the inclined ramp of the moving actuator for slidable engagement of the punch on the actuator, power means for moving said moving actuator relative to said stationary mandrel whereby said punch is caused to move on the inclined ramp of said moving actuator and forced radially outward through the guide aperture of said stationary mandrel to punch an opening through the side wall of the tubing, a stop bar extending adjacent said stationary mandrel, and clamp structure supported from said stop bar and selectively movable from a first position circumferentially engaging said tube and a second position wherein said claim structure is removed from circumferential engagement of the tubing.

6. The clamping structure according to claim 5 wherein said clamp structure has an indentation therein corresponding to the position of said punch such that said punch protrudes through the tubing at the indentation.

7. The punching apparatus according to claim 5 wherein said clamp structure includes a pair of movable jaws supported for movement on a plate attached to said stop bar, and cam means for selectively moving said jaws between a first position wherein said jaws circumferentially engage the tubing and a second position wherein said jaws are removed from circumferential engagement of the tubing.

8. The punch apparatus according to claim 1 further comprising:

a pair of stop bars extending parallel to and on opposite sides of said stationary mandrel, and a plurality of stop arms hingedly secured to each of said stop bars for selective engagement against said stationary mandrel, said stop arms being selectively positionable along the longitudinal axis of said stop bars for varying the position of engagement of said stop arms on said stationary mandrel.

9. The punch structure according to claim 8 further comprising clamp structure supported between said stop bars and selectively movable from a first position wherein said clamp structure circumferentially engages the tubing and a second position wherein said clamp structure is removed from circumferential engagement of the tubing.

10. The punch apparatus according to claim 7 further comprising:

a first plate receivable over one of said stop bars and a second plate receivable on the other of said stop bars, a pair of jaws supported for movement between said plates, and cam means interconnecting said jaws for moving said jaws from a first position circumferentially engaging the tubing and a second position wherein said jaws are removed from circumferential engagement of the tubing.

11. The punch apparatus according to claim 10 wherein one of said jaws is formed with an indentation corresponding to the position of said punch in the tubing such that said punch protrudes through the tubing at the indentation.

12. A method for punching a plurality of openings through tubing comprising:

engaging the tubing over a tubular stationary mandrel having a guide aperture through the wall thereof, butting the end of the tube against a swing stop engaged against said stationary mandrel, forcing a moving actuator in a first direction longitudinally through the stationary mandrel to force a punch engaged on the inclined end of the moving actuator through the guide aperture of the mandrel whereby the punch is forced radially outwardly to form an opening in the side wall of the tubing from the interior of the tubing, moving the actuator in a second direction opposite the first direction to withdraw the punch into the stationary mandrel, pivoting said swing stop arm from a stop bar supported to one side of said stationary mandrel, advancing the tubing onto said stationary mandrel to engagement with a second swing stop arm engaged against said stationary mandrel, and moving said actuator longitudinally within the stationary mandrel to force the punch radially outwardly through the guide aperture in the stationary mandrel to form a second opening in the side wall of the tubing.

13. The method according to claim 12 further comprising:

circumferentially engaging the tubing at the longitudinal position of the punch by a pair of jaws, each having a half circle trough for engagement around the tube, one of the troughs having an indentation corresponding to the area where the punch is to form the opening in the tube, and withdrawing the upper and lower jaws from circumferential engagement with the tubing after the opening has been punched in the tube.

* * * * *